United States Patent [19]

Raff et al.

[11] 4,060,339

[45] Nov. 29, 1977

[54] METHOD AND APPARATUS FOR CONTROLLING A GAS-PRODUCING FACILITY

[75] Inventors: Frederick L. Raff, Worth; Edward Szymanski, Bloom, both of Ill.

[73] Assignee: United States Steel Corporation, Pittsburgh, Pa.

[21] Appl. No.: 725,802

[22] Filed: Sept. 23, 1976

[51] Int. Cl.[2] ..... F04B 41/06

[52] U.S. Cl. ..... 417/2; 266/80; 266/142; 417/28; 417/53; 417/286; 417/295; 417/428

[58] Field of Search ..... 62/13; 266/80, 142, 266/143; 417/1-6, 53, 246-248, 250, 253, 17, 28, 42, 43, 295, 286, 426; 137/99

[56] References Cited

U.S. PATENT DOCUMENTS

| | | | |
|---|---|---|---|
| 1,695,953 | 12/1928 | Feild | 266/142 X |
| 2,942,866 | 6/1960 | Anderson | 417/2 X |
| 3,151,199 | 9/1964 | Flynn et al. | 417/6 X |
| 3,312,074 | 4/1967 | Keith et al. | 62/13 |
| 3,817,658 | 6/1974 | Murase | 417/2 |

*Primary Examiner*—William L. Freeh
*Assistant Examiner*—Edward Look
*Attorney, Agent, or Firm*—Walter P. Wood

[57] ABSTRACT

A method and apparatus for controlling a multiple-plant gas-producing facility which is subject to wide variations in the demand for its output. The invention is particularly applicable to an oxygen-producing facility for a steelmaking operation in which there are two independently operable oxygen-producing plants. It is impractical to shut down an oxygen-producing plant when its output temporarily is not needed. During periods of reduced demand conventional practice is to operate one plant at its normal rate to supply the needed oxygen and operate the other plant at a reduced rate and waste excess oxygen which cannot be liquefied and stored. The invention provides a way of combining the outputs of two plants, whereby both plants can operate at reduced rates during periods of reduced demand, and large scale waste is avoided.

10 Claims, 3 Drawing Figures

METHOD AND APPARATUS FOR CONTROLLING A GAS-PRODUCING FACILITY

This invention relates to an improved method and apparatus for controlling a multiple-plant gas-producing facility which is subject to wide variations in the demand for its output.

Although our invention is not thus limited, our control method and apparatus are particularly useful for the oxygen-producing facility of an oxygen steelmaking operation, either by the conventional basic oxygen process (BOP) or by the newer bottom-blown oxygen process (Q-BOP). Commonly an oxygen steelmaking installation includes two or more steelmaking funaces and at least two independently operable air separation plants for supplying oxygen. When the furnaces are operating at less than full capacity, the quantity of oxygen needed of course is less than normal, and only a single oxygen-producing plant may suffice to supply all the oxygen. An oxygen-producing plant includes an interchanger which is not readily shut down even though its output temporarily is not needed. In a two-plant facility, when demand is low, conventional practice is to operate one plant at its normal rate to supply the oxygen needed, and the other at a reduced rate and to liquefy and store as much of its output as possible. Nevertheless a large part of its output has been vented to the atmosphere and wasted. It has not been considered feasible to operate both plants at reduced rates and combine their outputs.

In one installation with which we are familiar, each of two interchangers of like construction produces oxygen at a normal rate of 600,000 cu. ft. per hour to supply two BOP furnaces. When the furnaces are operating at less than full capacity and only one interchanger is needed to supply oxygen, prior to our invention the other interchanger was operated at the lowest possible rate and about 100,000 cu. ft. per hour of its output was liquefied and stored. Nevertheless it was necessary to waste about 320,000 cu. ft. of 99.5% pure oxygen per hour. There was no way by which gaseous oxygen produced by one interchanger could be combined with that produced by the other, whereby both interchangers could operate at a reduced rate and avoid large scale waste.

The problem in combining the outputs of two interchangers arises in the operation of the basic load oxygen compressors (BLOC's). Each interchanger has its own BLOC. Oxygen produced by each interchanger normally goes to its respective BLOC, where it is cooled and pumped to a pressure of 230 psig, and thence goes to a pipeline leading to the BOP shop. When the furnaces operate at a low rate, one of the BLOC's is shut down. Either BLOC may be shut down, since there is a cross connection through which oxygen from either interchanger can go to either BLOC, but prior to our invention oxygen from both interchangers could not go to a single BLOC at the same time. The BLOC speed is regulated by a governor which itself is controlled by a pneumatic pressure signal representative of the quantity of oxygen going to the BLOC. With oxygen coming from more than one source in unequal volumes, it has not been considered feasible to develop a useful signal for controlling the BLOC speed.

In the description which follows, we describe our invention as applied to an oxygen-producing facility for a steel-making operation in which there are two independently operable oxygen-producing plants. Thus there are two interchangers and two BLOC's. "Normal operation" refers to operation with both BLOC's running. "Reduced operation" refers to operation with one BLOC running, the other shut down. This description is for illustrative purposes only and is not intended to limit the invention, since it is apparent the invention may have other applications where similar problems arise.

An object of our invention is to provide an improved method and apparatus for controlling a gas-producing facility which has independently operable gas-producing plants wherein we avoid large scale waste of gas whenever demand is low.

A further object is to provide an improved method and apparatus for controlling a gas-producing facility in which we make it possible for a single compressor, such as a BLOC, to accept gas from two or more independently operable gas-producing plants during periods of reduced operation, yet we maintain control of the compressor.

A further object is to provide an improved control method and apparatus for accomplishing the foregoing objects in which we combine the gas output of two or more plants during periods of reduced operation, whereby we can operate all plants at reduced rate and avoid large scale waste of gas, yet do not interfere with normal operation. In the drawings.

PLANT LAYOUT

Figure 1:
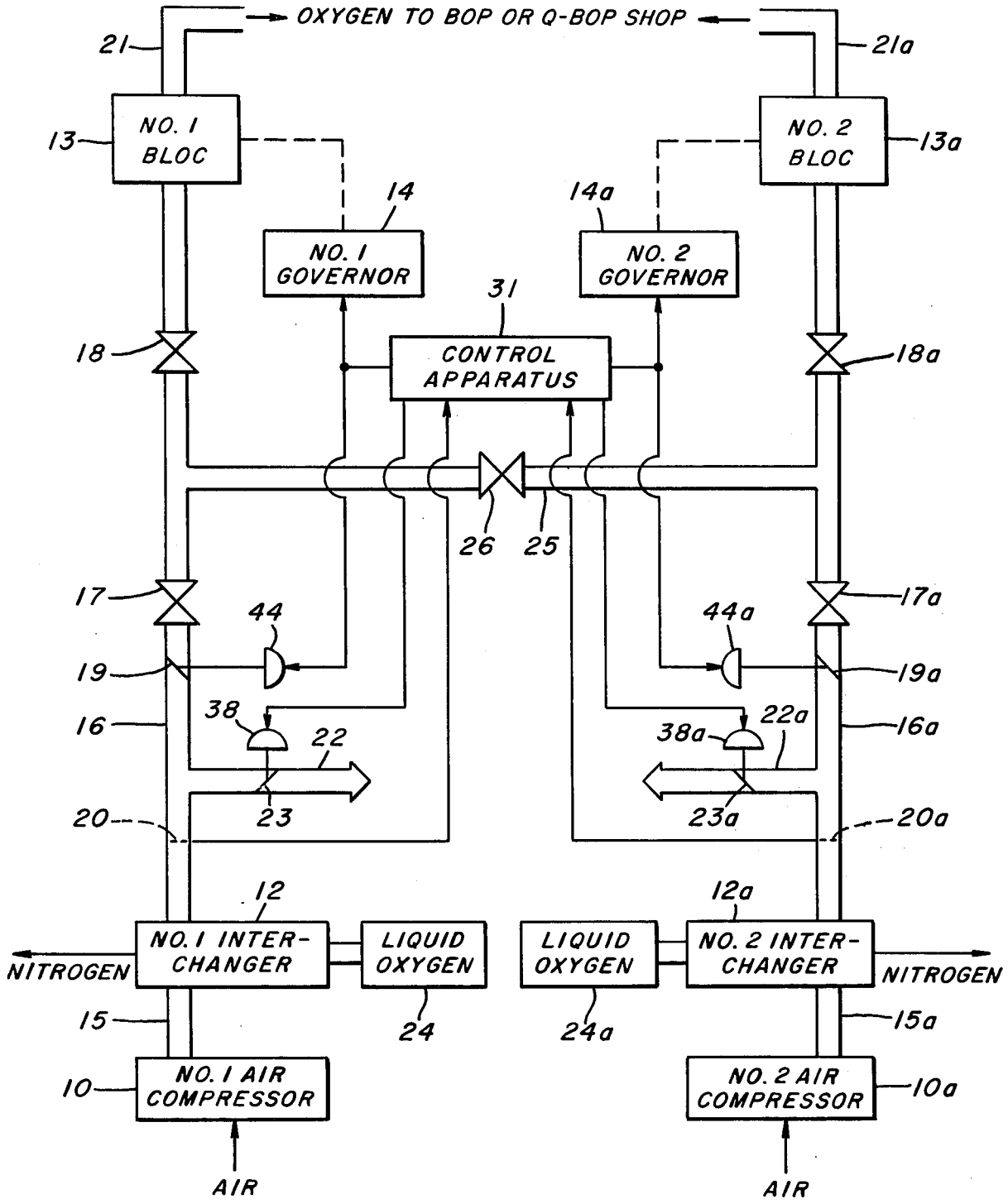
FIG. 1 is a schematic diagram of an oxygen-producing facility equipped with our improved control apparatus.

FIG. 1 shows an oxygen-producing facility made up of two independently operable plants of like construction, referred to as No. 1 and No. 2. No. 1 Plant includes an air compressor 10, an interchanger 12, a basic load oxygen compressor (BLOC) 13, and a governor 14 for regulating the speed of the BLOC. A pipe 15 connects the compressor 10 and the interchanger 12. A pipe 16 connects the interchanger 12 and the BLOC 13 and contains manually operable normally open valves 17 and 18, a diaphragm operated "make"valve 19, and a flow-measuring orifice 20. A pipeline 21 extends from the BLOC 13 to a BOP or Q-BOP shop (not shown). A vent pipe 22 to the atmosphere extends from pipe 16 and contains a diaphragm operated "vent" valve 23. A storage means 24 for liquid oxygen is connected to the interchanger 12. No. 2 Plant includes similar parts identified in FIG. 1 by similar reference characters bearing a subscript "*a*."A pipe 25 affords a cross connection between pipes 16 and **16*a* and contains a manually operable normally closed valve 26**. The foregoing parts are conventional and hence are not described in detail here.

In accordance with conventional practice, air is introduced to the interchangers 12 and **12*a* from the compressors 10 and 10*a* respectively. In the interchangers the air is cooled, cleaned, liquefied and separated into oxygen and other constituents, mainly nitrogen. Liquid nitrogen is used for heat exchange purposes within the interchanger, but thereafter may be vented to the atmosphere. In normal operation gaseous oxygen from both interchangers 12 and 12*a* goes through pipes 16 and 16*a* to the respective BLOC's 13 and 13*a*, where it is further compressed, and thence routed through pipes 21 and 21*a* to the BOP or Q-BOP shop. If desired, some oxygen can be liquefied and sent to the storage means 24 or 24*a***.

CONTROL APPARATUS

Figure 2:
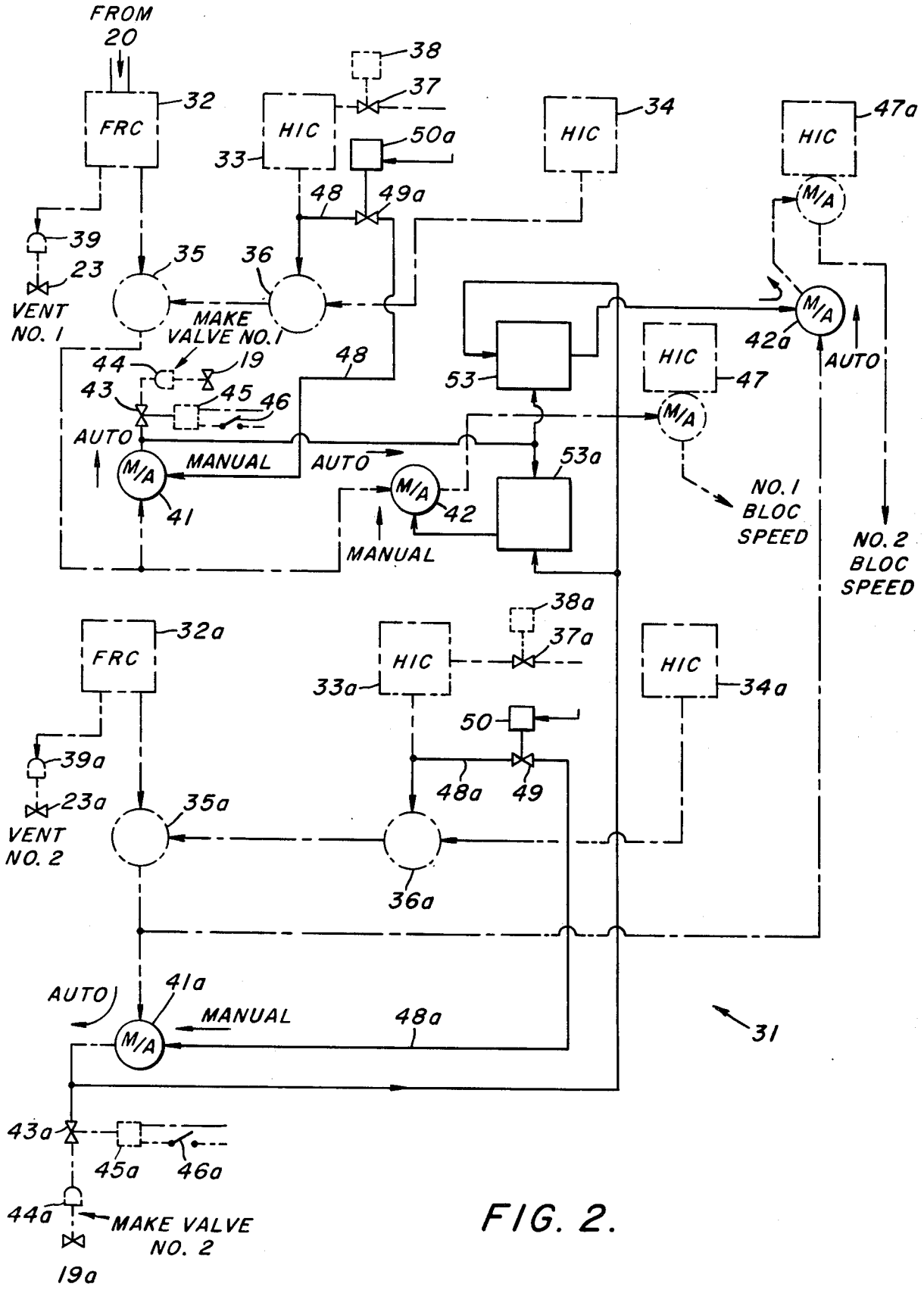
FIG. 2 is a schematic diagram of one form of our control apparatus.
Figure 3:
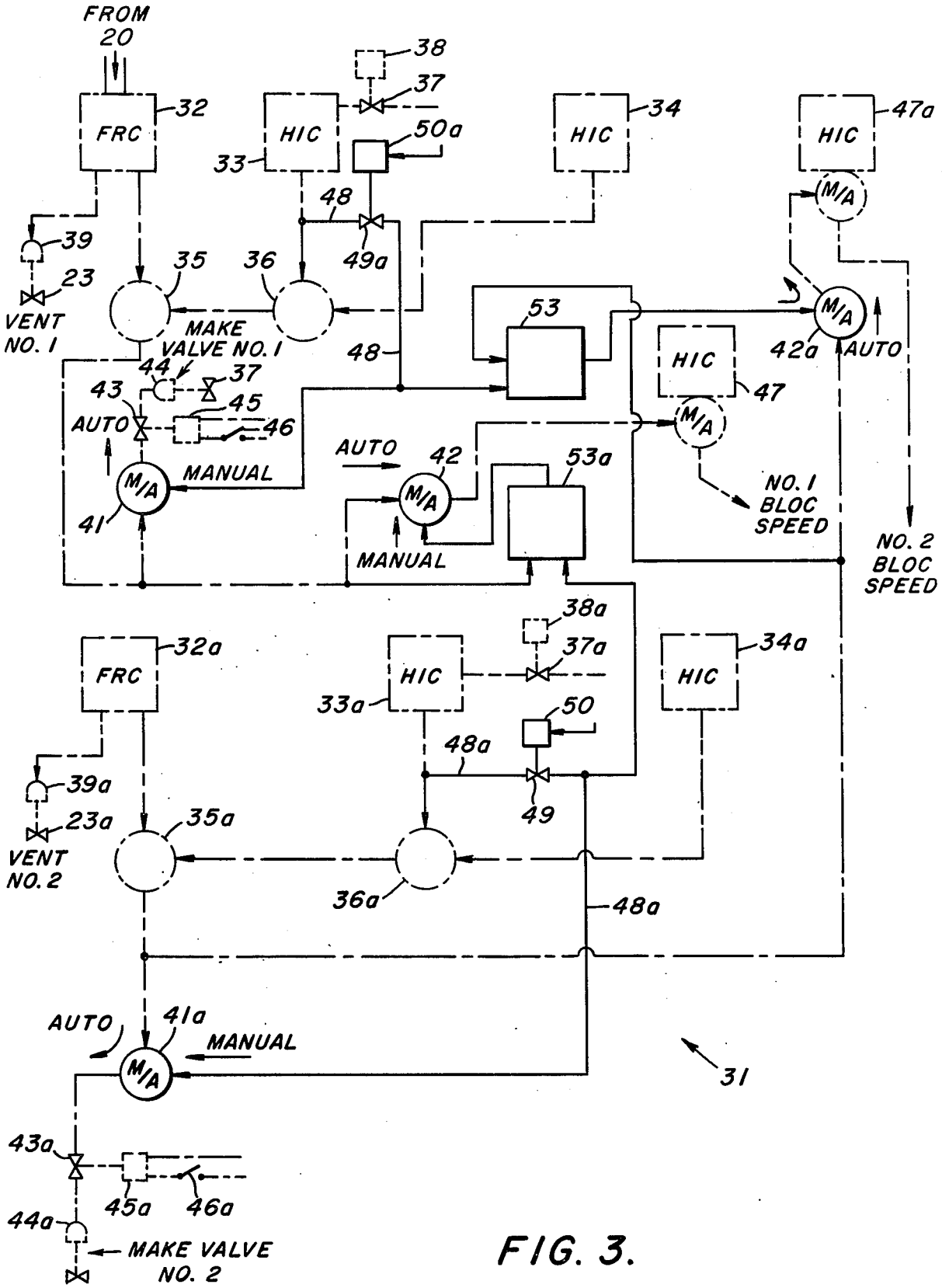
FIG. 3 is a schematic diagram of an alternative form of our control apparatus.

The operation of the plant is controlled by a control apparatus 31, within which our invention is incorporated. We show the control apparatus only in block form in FIG. 1 but in more detail in FIG. 2 and in an alternative form in FIG. 3. The components of the control apparatus per se are known instruments which operate in response to pneumatic pressure signals. Hence no detailed description of these instruments is offered, but examples of suitable commercially available instruments are identified hereinafter. In FIGS. 2 and 3 we use dot-dash lines to indicate components used conventionally in controlling an oxygen-producing facility, and solid lines to indicate components added in accordance with our invention. There are duplicate sets of components for controlling No. 1 and No. 2 Plants. We describe in detail the relation of the components for controlling No. 1 Plant only. In FIGS. 2 and 3 we identify the components which either control or are controlled by No. 2 Plant by the same reference characters bearing a subscript "*a*."

The control apparatus 31 shown in FIG. 2 includes first a flow recorder controller (FRC) 32, alternative handindicating controllers (HIC's) 33 and 34, and two low-selector relays 35 and 36, as in conventional apparatus for controlling an oxygen-producing plant. Air is supplied to HIC 33 through a normally open valve 37, which has an operating solenoid 38. The solenoid is interconnected with the compressor 10 to interrupt the air supply whenever the compressor is tripped. Two alternative HIC's are used and physically are at different locations so that the operator always is near one of them. FRC 32 receives an input signal from the flow-mesuring orifice 20 representing the volume of oxygen passing through pipe 16. An output signal goes from FRC 32 to a diaphragm device 39, which operates the "vent" valve 23 and to the first low-selector relay 35. Signals from HIC's 33 and 34 go to the second low-selector relay 36, which also transmits a signal to the first low-selector relay 35. A low selector relay selects the lower of two input signals for transmission as its output signal. Both HIC's 33 and 34 are manual overrides for FRC 32 and normally are set to transmit output signals at least as high as the maximum output signal from FRC 32. Normally the plant operates automatically and the low selector relay 35 selects the signal from FRC 32 as its output signal.

The output signal from FRC 32, transmitted through the low selector relay 35, goes to two "manual-automatic" switches 41 and 42 arranged in parallel. These switches are added to the conventional control apparatus in accordance with our invention. During normal operation of the two plants, we set switches 41 and 42 to their "automatic" position, whereby the output signal from FRC 32 passes through them unchanged. The signal which passes through switch 41 goes through a normally open valve 43 to a diaphragm device 44 which operates the "make" valve 19. Valve 43 has an operating solenoid 45 which is interconnected with No. 1 BLOC 13 and is energized to open the valve whenever No. 1 BLOC is running. Solenoid 45 has a bypass switch 46, added in accordance with our invention, so that we may open valve 43 when No. 1 BLOC is not running. The signal which passes through the other switch 42 goes to another hand-indicating controller (HIC) 47 and thence to the governor 14 for BLOC 13.

According to our invention, we connect a line 48 into the line which connects HIC 33 and the low selector switch 36. Line 48 extends to the "manual-automatic" switch 41 and contains a valve 49*a* which has an operating solenoid 50*a*. This solenoid is interconnected with No. 2 BLOC 13*a* and is energized whenever No. 2 BLOC is running. When the solenoid is energized, the valve is open, and line 48 carries a pneumatic pressure signal from HIC 33 to the "manual-automatic" switch 41. When switch 41 is in its "automatic" position for normal operation, this signal is blocked at switch 41 and does not affect operation of the control apparatus.

Also according to the form our invention shown in FIG. 2, we connect a summing relay 53 to receive input signals from the outlet sides of both switch 41 and the corresponding switch 41*a* of the control apparatus of No. 2 Plant. The summing relay 53 adds the two input signals and transmits an output signal representative of their sum to switch 42*a* of No. 2 Plant. Likewise we connect the summing relay 53*a* of the control apparatus of No. 2 Plant to receive input signals from the outlet sides of both switches 41 and 41*a* of both plants and to transmit an output signal to switch 42 of No. 1 Plant. When switches 42 and 42*a* are in their "automatic" positions for normal operation, the output signals from the summing relays are blocked at the representative switches and do not affect operation of the control apparatus.

FIG. 3 shows an alternative arrangement for connecting the summing relays of our control apparatus. The same components are present as in FIG. 2 and are identified by the same reference characters. In FIG. 2 both summing relays 53 and 53*a* receive their input signals from both plants from the outlet sides of the "manual-automatic" switches 41 and 41*a*. In FIG. 3 the summing relay 53 receives its input signal from No. 1 Plant from line 48 and its input signal from No. 2 Plant from the outlet side of the low selector relay 35*a*. Likewise the summing relay 53*a* receives its input signal from No. 2 Plant from line 48*a* and its input signal from No. 1 Plant from the outlet side of the low selector relay 35.

In FIG. 2 it is apparent that both summing relays 53 and 53*a* receive direct input signals from both plants at all times. In FIG. 3 the input signal to the summing relay 53*a* from No. 2 Plant is cut off when No. 1 BLOC 13 is shut down, since valve 49 closes. However, this does not affect operation of the control apparatus since the other summing relay 53 controls the speed of No. 2 BLOC 13*a*, as hereinafter explained. The opposite relation exists when No. 2 BLOC is shut down. Hence the two forms are equivalent in their operation.

COMPONENTS

As already stated, the components of our control apparatus are known instruments which are available commercially. One example of a set of suitable instruments is as follows:

Flow recorder controllers: Foxboro Model 58P4F
Hand-indicating controllers: Moore Products Model 524
Low-selector relays: Moore Products Model 61F
Manual-automatic switches: Foxboro Model 36494 Air Switch Summing relays: Bailey Meter Co. Type AD51002

Numerous alternative instruments may be used, and our invention is not limited to any particular set of instruments.

NORMAL OPERATION

Operation of the control apparatus is best explained by referring to exemplary numerical values for the various pneumatic pressure signals. In referring to these values, we do not intend to limit the invention, but only to illustrate a typical relation which may exist. We assume that the diaphragm devices 44 and 44a operate on signals in the range of 3 to 7 psig, and that the respective "make" valves 19 and 19a are fully closed at 3 psig and fully open at 7 psig. We assume that the BLOC's 13 and 13a operate at their minimum speeds when the signals to their governors 14 and 14a are within the range of 3 to 7 psig, and that the BLOC speed is constant at any signal within this range. The BLOC's operate at increasing speeds as the signals increase from 7 psig to a maximum of 11 psig. We assume the diaphragm devices 39 and 39a operate on signals in the range of 11 to 15 psig and that the respective"vent" valves 23 and 23a are fully closed at signals of 11 psig and below and fully open at 15 psig.

As a consequence, during normal operation a signal from FRC 32 or 32a in the range of 3 to 7 psig varies the opening of the "make" valve 19 or 19a, but maintains the BLOC 13 or 13a at minimum speed and the "vent" valve 23 or 23a fully closed. A signal in the range of 7 to 11 psig maintains the "make" valve fully open, varies the BLOC speed, and continues to maintain the "vent" valve fully closed. A signal in the range of 11 to 15 psig maintains the "make" valve fully open and the BLOC speed at its maximum, and varies the opening of the "vent" valve. For normal operation, we set the four "manual-automatic" switches 41, 41a, 42 and 42a to their "automatic" positions and the four HIC's 33, 33a, 34 and 34a to pressures above the range of signals from FRC 32 and 32a, as already stated. The low selector relays 35 and 35a transmit the signals from the FRC's through the switches 41, 41a, 42 and 42a to control the opening of the "make" valves 19 and 19a and the speeds of the BLOC's 13 and 13a in accordance with the volume of oxygen reaching the BLOC. Signals from the FRC's also control the opening of the "vent" valves 23 and 23a directly. If at any time it is necessary to go to manual control for either plant, one of the HIC's can be set to a lower pressure, whereupon the corresponding low selector relay transmits the HIC signal rather than the FRC signal. The HIC signal controls only the opening of the "make" valve and the BLOC speed; the FRC signal continues to control the opening of the "vent" valve. Hence during periods of normal operation, both plants operate in the conventional way, and the components added in accordance with our invention do not interfere.

REDUCED OPERATION

For reduced operation with No. 2 BLOC 13a running and No. 1 BLOC 13 down, we close valve 18 and open valve 26, whereby the output of No. 1 Interchanger 12 can be diverted through the cross connection 25 to No. 2 BLOC 13a. We throw the "manual-automatic" switches 41 and 42a to their "manual" positions. We set HIC 33 to transmit a low pressure output signal, in the present example 3 psig. The low-selector relays 36 and 35 now transmit the 3 psig signal. Solenoids 45a and 50a remain energized and valves 43a and 49a remain open. Shutting down No. 1 BLOC deenergizes solenoid 50 and closes valve 49, and normally would deenergize solenoid 45 and close valve 43, but we close the bypass switch 46 so that valve 43 remains open. We cut back production from both the No. 1 and No. 2 Interchangers 12 and 12a, but No. 2 Plant remains on automaic operation. The signal from FRC 32a is lowered to about 4 psig which signal continues to control the "make" valve 19a as before. Since switch 42a is in its "manual" position, it blocks the direct signal from the low selector relay 35a to HIC 47a, but passes the signal from the summing relay 53 to HIC 47a. The output signal from the summing relay represents the combined signals from FRC 32a and HIC 33, in this example 7 psig.

At a 7 psig signal No. 2 BLOC 13a runs at minimum speed. The 3 psig signal from HIC 33 also reaches the diaphragm device 44 via valve line 48 and switch 41, but this signal is not of sufficient magnitude to open the "make" valve 19. For the moment the entire output of the No. 1 Interchanger is vented through the "vent" valve 23. Next we manually adjust HIC 33 to raise the magnitude of its output signal. For example, if we raise the signal to 4 psig, the "make" valve 19 opens to a position one quarter of its full open position. Some of the gas from No. 1 Interchanger 12 now flows through the cross connection 25 to No. 2 BLOC 13a. The output signal transmitted from the summing relay 53 to HIC 47a increases to 8 psig, and the speed of No. 2 BLOC increases in proportion. Thus No. 2 BLOC receives gas from both Interchangers 12 and 12a and its speed is under control in accordance with the gas volume.

For reduced operation with No. 1 BLOC 13 running and No. 2 BLOC 13a shut down, we throw the opposite "manual-automatic" switches 41a and 42 to the "manual" positions and reduce the output signal from HIC 33a to 3 psig. We close the bypass switch 46a. The operation is similar to that already described, but with Plant No. 1 on automatic operation and the summing relay 53a controlling the speed of No. 1 BLOC.

In either instance our invention enables both interchangers to operate at reduced rate and to supply their combined ouput of gas to a single BLOC. The BLOC is controlled by a signal which represents the sum of the gas volumes produced by the two interchangers. A conventional BLOC is capable of operating somewhat above its rated capacity and can readily handle the output of two interchangers operating at reduced rates. If it is necessary to vent any gaseous oxygen, the volume wasted is negligible compared with the large scale waste during periods of reduced operation in conventional practice.

We claim:

1. In the operation of a gas-producing facility which includes at least two independently operable plants, each of said plants having a respective interchanger and a respective compressor for receiving gas from its interchanger during normal operation, an improved method of operating and controlling said plants during periods of reduced operation when less then all of said compressors are running, said method comprising operating said interchangers at reduced rates, directing the gas output from said interchangers to a compressor which is running, developing a control signal representative of the combined gas outputs of the interchangers, and utilizing said signal to control the speed of the compressor which is running.

2. A method as defined in claim 1 in which individual signals are developed representative of the gas outputs of each of said interchangers, and said individual signals are added to provide said combined signal.

3. A method as defined in claim 1 in which the gas is oxygen.

4. In the operation of an oxygen-producing facility which includes at least two independently operable plants, each of said plants having a respective interchanger, a respective basic load oxygen compressor to receive oxygen from its interchanger, and respective control apparatus which operates automatically to regulate the speed of the compressor in accordance with the volume of oxygen going thereto during normal operation of said plants, an improved method of operating said plants during periods of reduced operation when only one of said compressors is running, said method comprising operating both of said interchangers at reduced rates, directing the oxygen outputs of both of said interchangers to the compressor which is running, developing individual control signals representative of the volume of oxygen produced by each of said interchangers, adding said individual signals to provide a combined signal representative of the volume of oxygen going to the compressor which is running, and utilizing said combined signal to control the speed of this compressor.

5. A method as defined in claim 4 in which the control apparatus of the plant, the compressor of which is running, continues on automatic operation during periods of reduced operation, and the other plant is operated manually during such periods.

6. In a gas-producing facility which includes at least two independently operable plants, each of said plants having a respective interchanger, a respective compressor for receiving gas from its interchanger during normal operation, and a respective apparatus for controlling the speed of the compressor in accordance with the output of gas from the interchanger, the combination therewith of an improved apparatus for controlling the speed of a compressor which is running during periods of reduced operation when less than all the compressors are running, said apparatus comprising means for developing a signal representative of the combined output of gas from the interchangers, and means for transmitting said signal to the speed-controlling apparatus of the compressor which is running.

7. In an oxygen-producing facility which includes at least two independently operable plants, each of said plants having a respective interchanger, a respective basic load oxygen compressor for receiving oxygen from its interchanger during normal operation, and a respective control apparatus which operates automatically to regulate the speed of the compressor in accordance with the volume of oxygen going to the compressor during normal operation, the combination therewith of components within said apparatus for controlling the speed of a compressor which is running during periods of reduced operation when one compressor is shut down, said components comprising means for developing signals representative of the oxygen output of each of said interchangers, means for adding said signals to develop a combined signal representative of the volume of oxygen going to the compressor which is running, and means for utilizing said combined signal to control the speed of this compressor.

8. A combination as defined in claim 7 in which said components include manual-automatic switches which in automatic position pass signals for automatic control of said compressors for normal operation of said plants, and in manual position block the signals for automatic operation and pass signals for developing said combined signal for reduced operation.

9. A combination as defined in claim 8 in which the means for adding said signals is a summing relay connected to receive input signals from said switches and transmit said combined signal.

10. In a combination which includes two oxygen-producing plants, each comprising a respective interchanger, a respective basic load oxygen compressor for receiving oxygen from its interchanger, and an apparatus for controlling the speed of said compressors in accordance with the volume of oxygen going thereto, the improvement in which said control apparatus comprises means for developing a signal representative of the combined oxygen output of said interchangers to control the speed of a single one of said compressors enabling both of said interchangers to operate at reduced rate and supply a single compressor during periods of reduced operation.

* * * * *